US007828605B1

(12) United States Patent
Tang et al.

(10) Patent No.: US 7,828,605 B1
(45) Date of Patent: Nov. 9, 2010

(54) CONDUCTING MECHANISM FOR ELECTRONIC DEVICE

(75) Inventors: Zi-Ming Tang, Shenzhen (CN); Wei-Jun Wang, Shenzhen (CN)

(73) Assignees: Hong Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/511,082

(22) Filed: Jul. 29, 2009

(30) Foreign Application Priority Data

May 18, 2009 (CN) ..... 2009 1 0302405

(51) Int. Cl.
*H01R 13/24* (2006.01)

(52) U.S. Cl. ..... 439/700

(58) Field of Classification Search ..... 439/700, 439/500, 482, 824
See application file for complete search history.

(56) References Cited

U.S. PATENT DOCUMENTS 4,072,384 A * 2/1978 Moore ..... 439/595
4,255,010 A * 3/1981 Jullien ..... 439/655
5,697,124 A * 12/1997 Jung ..... 16/341
5,961,356 A * 10/1999 Fekete ..... 439/700
6,053,765 A * 4/2000 Eakins ..... 439/557
6,256,481 B1 * 7/2001 Jeong et al. ..... 455/575.3
6,340,320 B1 * 1/2002 Ogawa ..... 439/824
6,350,155 B1 * 2/2002 Mullinger-Bausch et al. ..... 439/675
6,634,902 B1 * 10/2003 Pirovic ..... 439/337
7,393,227 B2 * 7/2008 Scholeno et al. ..... 439/243
7,433,467 B2 * 10/2008 Yi ..... 379/433.13
2006/0166564 A1 * 7/2006 Baranowski ..... 439/700
2008/0003888 A1 * 1/2008 Xu ..... 439/700
2009/0221189 A1 * 9/2009 Xu ..... 439/700

* cited by examiner

*Primary Examiner*—T C Patel
*Assistant Examiner*—Harshad C Patel
(74) *Attorney, Agent, or Firm*—Zhigang Ma

(57) ABSTRACT

A conducting mechanism includes a conducting member, an engaging member, a spring, and an insulting member. The spring connects the conducting member to the engaging member. The conducting member and the engaging member are slidably received in the insulating member, and a portion of the conducting member extends out of the insulating member.

7 Claims, 5 Drawing Sheets

CONDUCTING MECHANISM FOR ELECTRONIC DEVICE

BACKGROUND

1. Technical Field

The present disclosure relates generally to conducting mechanisms and, more particularly, to a conducting mechanism electrically connected to a battery.

2. Description of Related Art

Electronic devices, such as wireless keyboards, are generally powered by batteries. A conducting mechanism electrically connects the batteries to the device.

A commonly structured electronic device includes a main body, a battery, and a conducting mechanism. The main body forms a battery bay. The conducting mechanism includes an engaging member and a spring fixed to the engaging member. The engaging member is positioned in a bottom of the battery bay. When the battery is received in the battery bay, the anode of the battery resists the spring.

However, the spring of the conducting mechanism, deformed when external force is applied, is likely to contact the conducting inner surface of the battery bay, resulting in a short circuit of the battery.

Therefore, a conducting mechanism which overcomes the described limitations is desirable.

BRIEF DESCRIPTION OF THE DRAWINGS

The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
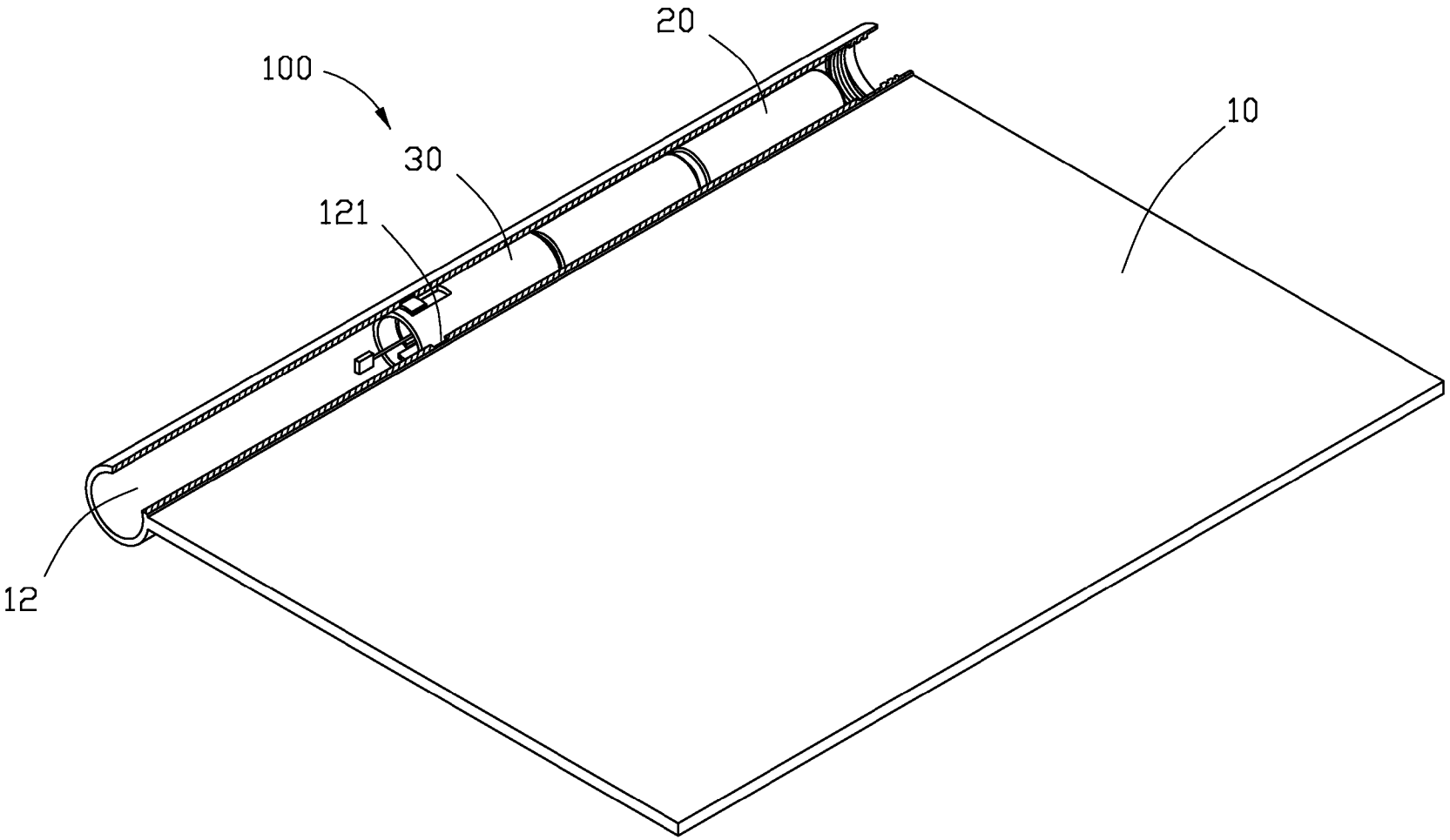
FIG. 1 is an assembled, isometric view of an embodiment of a conducting mechanism used in an electronic device.

Referring to FIG. 1, an electronic device 100 includes a main body 10, two batteries 20, and a conducting mechanism 30. The main body 10 forms a battery bay 12 on a side thereof. The batteries 20 and the conducting mechanism 30 are received in the battery bay 12. The conducting mechanism 30 resists the anode of one battery 20. In the illustrated embodiment, the electronic device 10 is a wireless keyboard, and the batteries 20 are alkaline batteries. The battery bay 12 is a substantially hollow cylinder. The battery bay 12 defines an annular groove 121 in a middle portion thereof.

Figure 2:
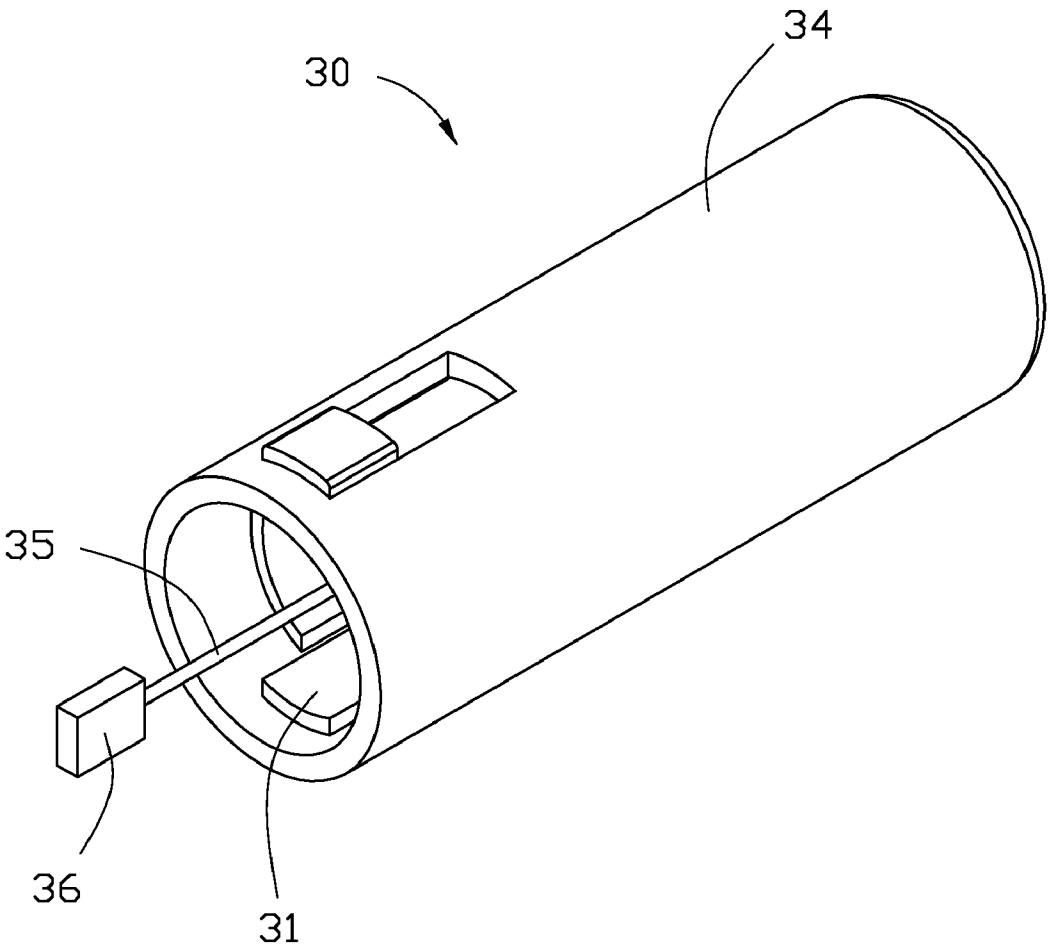
FIG. 2 is an assembled, isometric view of the conducting mechanism of FIG. 1.
Figure 3:
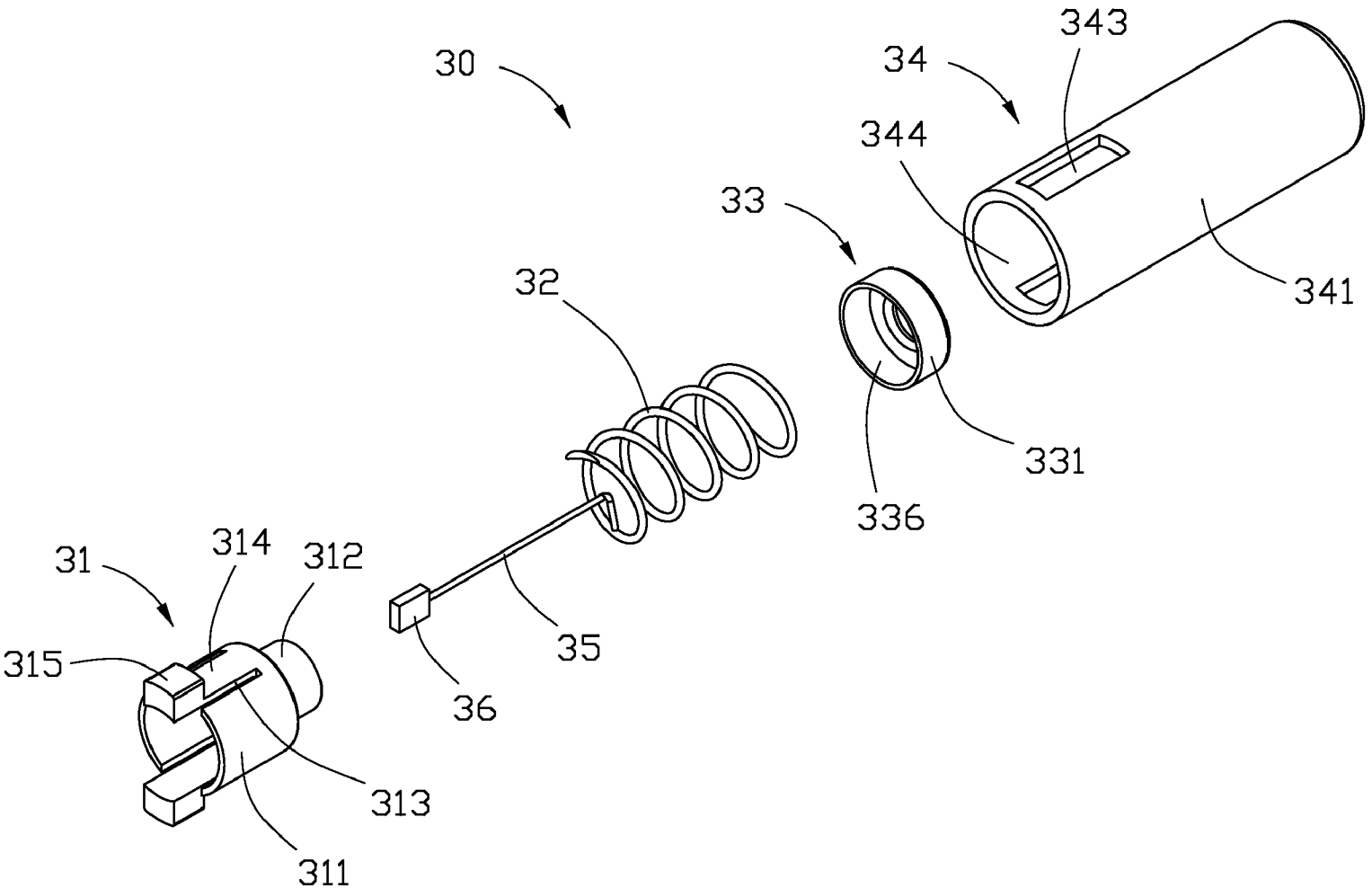
FIG. 3 is an exploded, isometric view of the conducting mechanism of FIG. 2.
Figure 4:
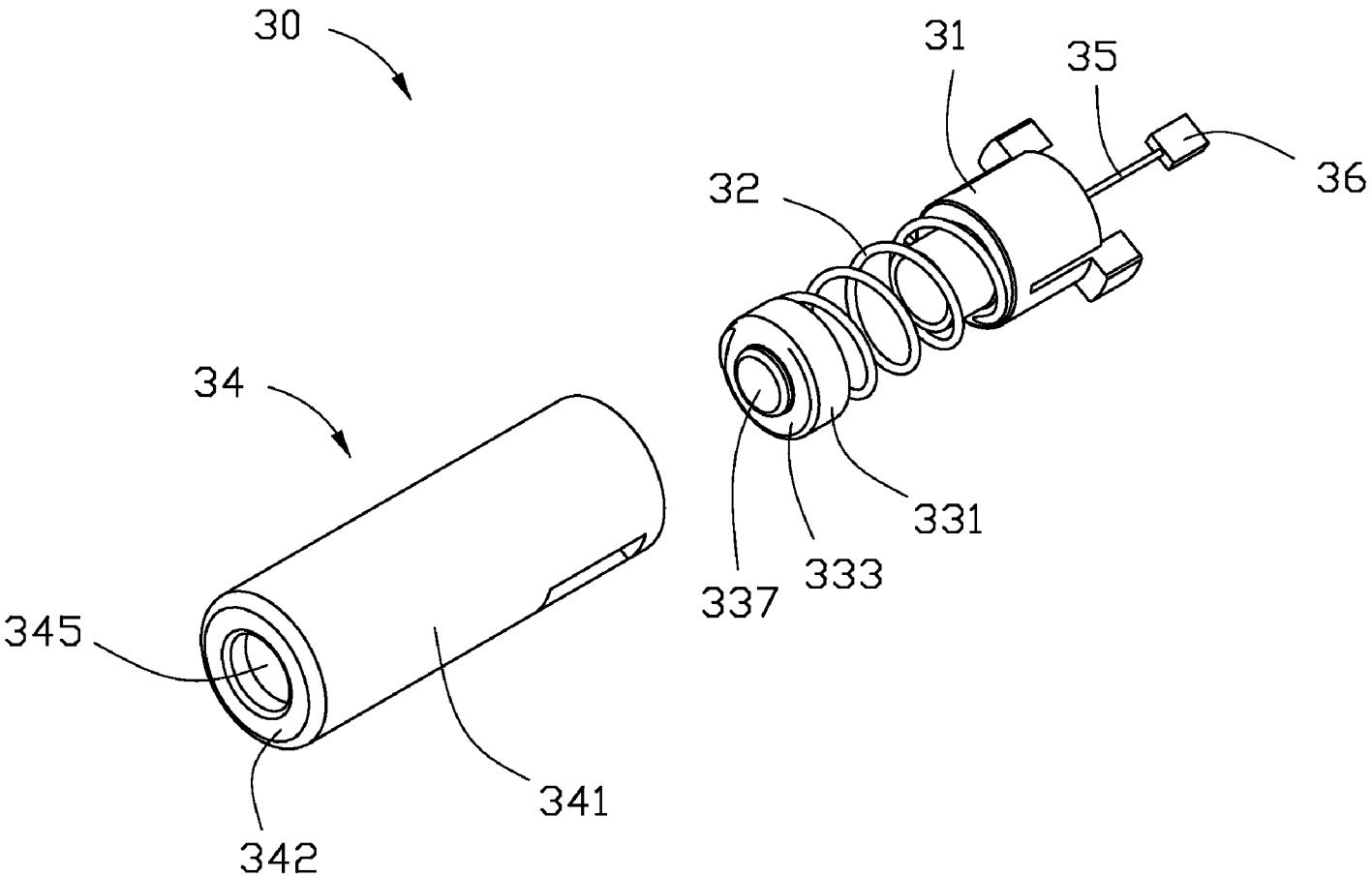
FIG. 4 is a partially assembled view of the conducting mechanism of FIG. 2.

Referring to FIGS. 2 through 4, the conducting mechanism 30 includes an engaging member 31, a spring 32, a conducting member 33, and an insulating member 34.

The engaging member 31 includes a hollow cylindrical main portion 311 and a fixing portion 312 formed on an end of the main portion 311. The main portion 311 defines two pairs of elongated grooves 313 on opposite sides. An elastic portion 314 is formed between each pair of grooves 313. A restricting protrusion 315 is formed on an end of each elastic portion 314 away from the fixing portion 312. The fixing portion 312 defines a through hole 317 in a center portion.

The spring 32 is sleeved on the fixing portion 312 of the engaging member 31, and is made of conducting materials, such as iron or steel.

The conducting member 33 includes a bottom wall 333 and a sidewall 331 extending from an edge of the bottom wall 333. The bottom wall 333 and the sidewall 331 cooperatively define an assembly groove 336. An end of the spring 32 is received in the assembly groove 336. A resisting portion 337 is formed on a center portion of the bottom wall 333, and configured for resisting the anode of the battery 20.

The insulating member 34 includes a sidewall 341 and a bottom wall 342 formed on an end of the sidewall 341. The sidewall 341 is substantially cylindrical and defines a cylindrical receiving chamber 344. The conducting member 33 is slidably received in the receiving chamber 344. The spring 32 is received in the receiving chamber 344, and can be compressed along the axis of the insulating member 34. The sidewall 341 defines two sliding grooves 343 in opposite sides, to receive the restricting protrusions 315. The bottom wall 342 defines a circular assembly hole 345 in a center portion. The resisting portion 337 of the conducting member 33 is configured to extend through the assembly hole 345 and resist the anode of the battery 20.

The conducting mechanism 30 further includes an electrical wire 35 and a connector 36 electrically connected to the electrical wire 35. The electrical wire 35 extends through the engaging member 31 and electrically connects the spring 32. The connector 36 is configured to connect other electrical components of the electronic device 100.

Figure 5:
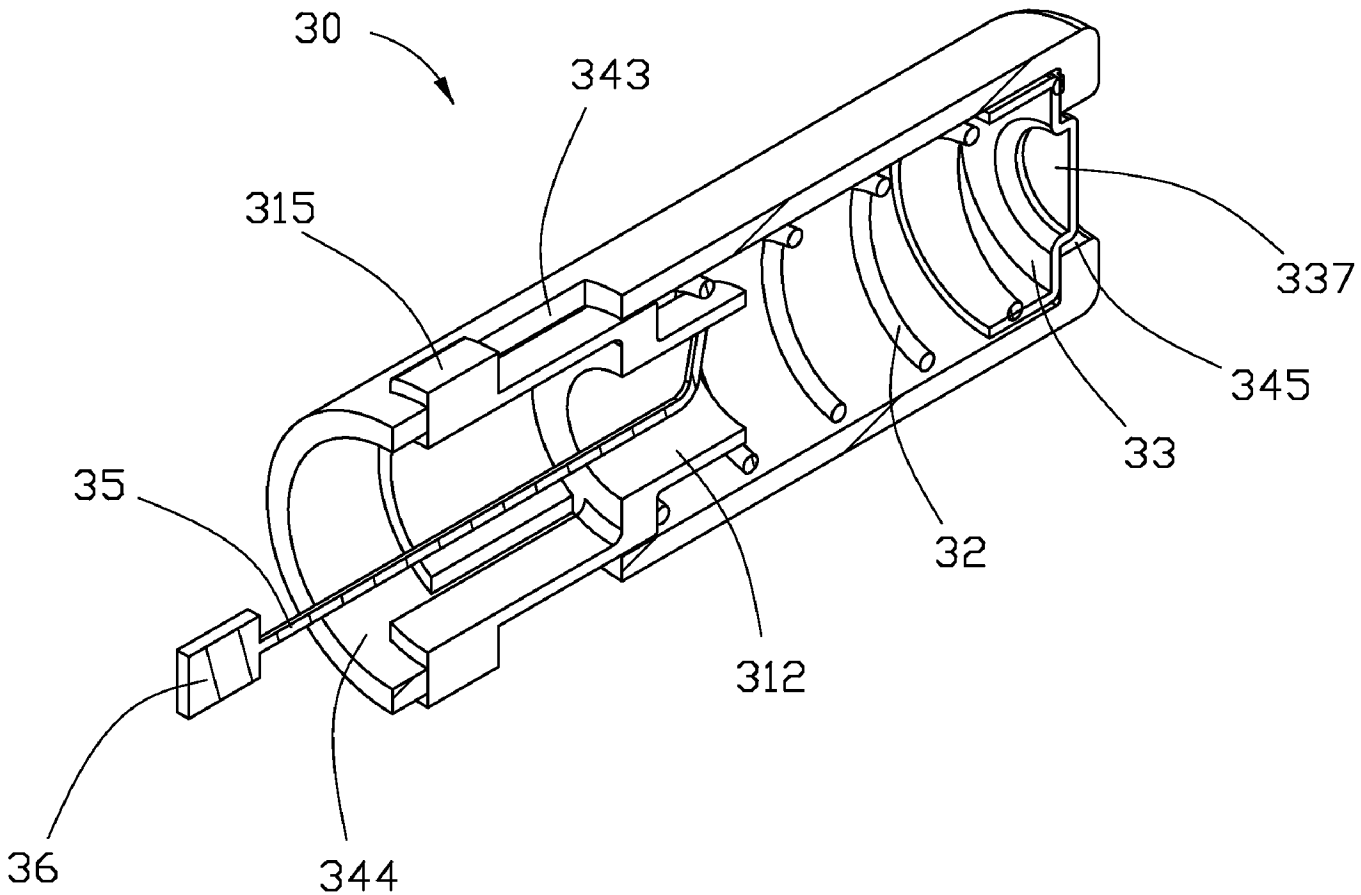
FIG. 5 is a cutaway view of the conducting mechanism of FIG. 2.

Referring to FIGS. 1, 4 and 5, during assembly of the conducting mechanism 30, the electrical wire 35 is connected to the connector 36 and the spring 32 respectively. The electrical wire 35 extends through the engaging member 31. One end of the spring 32 is sleeved on the fixing portion 312 of the engaging member 31, and the other end of the spring 32 is received in the assembly groove 336 of the conducting member 33. The conducting member 33, the spring 32, and the engaging member 31 are positioned in the receiving chamber 344 of the insulating member 34. The restricting protrusions 315 engage the sliding grooves 343 of the insulating member 34, and the resisting portion 337 engages the assembly hole 345 of the insulating member 34. After the conducting mechanism 30 is assembled, the conducting mechanism 30 is positioned in the battery bay 12 of the main body 10, with the restricting protrusions 315 engaging the annular groove 121 of the battery bay 12. Thus, the conducting mechanism 30 is fixed in the battery bay 12.

The conducting member 33 of the conducting mechanism 30 is positioned in the insulating member 34, and can move together with the insulating member 34 in the battery bay 12 of the main body 10. The conducting member 33 and the spring 32 are insulated with the inner surface of the battery bay 12, thus protecting the conducting mechanism 30 from short circuit.

It should be pointed out that the engaging member 31 may form a single restricting protrusion 315 or more than two restricting protrusions 315, correspondingly, the insulating member 34 defines one sliding groove 343 or more than two sliding grooves 343. In addition, the electronic device 100 may include a single battery 20 and more than two batteries 20 to supply electricity.

It is believed that the disclosure and its advantages will be understood from the foregoing description, and it will be apparent that various changes may be made thereto without departing from the spirit and scope of the disclosure or sacrificing all of its material advantages.

What is claimed is:

1. A conducting mechanism, comprising:

a conducting member;

an engaging member;

a spring positioned between the conducting member and the engaging member;

an insulating member in which the conducting member and the engaging member are slidably received, and a portion of the conducting member exposed from the insulating member; and an electrical wire extending through the engaging member, wherein an end of the spring is directly electrically connected to the electrical wire, and the other end of the spring is electrically connected to the conducting member.

2. The conducting mechanism of claim 1, wherein the insulating member comprises a sidewall on an end of which a bottom wall is formed, wherein the bottom wall defines an assembly hole in a center portion; and the conducting member comprises a resisting portion extending through the assembly hole of the insulating member.

3. The conducting mechanism of claim 1, wherein the conducting member comprises a bottom wall and a sidewall extending from an edge thereof, wherein the bottom wall and the sidewall cooperatively define an assembly groove in which one end of the spring is received.

4. The conducting mechanism of claim 3, wherein the engaging member comprises a main portion and a fixing portion formed on an end thereof; and wherein the other end of the spring is sleeved on the fixing portion.

5. The conducting mechanism of claim 4, wherein at least one restricting protrusion is formed on the main portion, the insulating member defines at least one sliding groove, and the at least one restricting protrusion is received in the at least one sliding groove of the main body.

6. The conducting mechanism of claim 5, wherein the main portion defines at least one pair of grooves between each pair of which an elastic portion is formed; and the restricting protrusion is formed on an end of each elastic portion away from the fixing portion.

7. The conducting mechanism of claim 1, further comprising a connector electrically connected to the electrical wire.

* * * * *